US006190273B1

(12) United States Patent
Maxey et al.

(10) Patent No.: US 6,190,273 B1
(45) Date of Patent: Feb. 20, 2001

(54) BALL WITH RAISED SEAM

(75) Inventors: Danny Wade Maxey; Dan Stephen Pitsenberger, both of Tullahoma, TN (US)

(73) Assignee: Worth, Inc., Tullahoma, TN (US)

( * ) Notice: Under 35 U.S.C. 154(b), the term of this patent shall be extended for 0 days.

(21) Appl. No.: 09/368,049

(22) Filed: Aug. 3, 1999

Related U.S. Application Data

(60) Provisional application No. 60/134,679, filed on May 18, 1999.

(51) Int. Cl.[7] ..... A63B 37/12
(52) U.S. Cl. ..... 473/598; 473/607
(58) Field of Search ..... 473/597, 598, 473/600, 601, 602, 604, 606, 603, 605

(56) References Cited

U.S. PATENT DOCUMENTS

| | | | | |
|---|---|---|---|---|
| 2,245,115 | * | 6/1941 | Reach | 473/597 |
| 2,325,128 | * | 7/1943 | Grady | 473/597 |
| 4,222,806 | * | 9/1980 | Parker | 473/606 |
| 4,241,118 | * | 12/1980 | Skelton et al. | 473/606 |
| 5,253,865 | * | 10/1993 | Kinnee | 473/598 |
| 5,762,573 | * | 6/1998 | Kennedy, III et al. | 473/604 |
| 5,772,544 | | 6/1998 | Yang | 473/598 |

OTHER PUBLICATIONS

"Wilson SST Baseball", retrieved from the internet on Jul. 21, 2000: http://www.wilsonsports.com/baseball/ncaa_ball.html.*

* cited by examiner

*Primary Examiner*—Steven Wong
(74) *Attorney, Agent, or Firm*—Waddey & Patterson; Lucian Wayne Beavers

(57) ABSTRACT

A construction for a baseball or softball having a raised seam is provided. The ball includes a core and first and second cover pieces. Each cover piece has an inner surface, an outer surface and a peripheral edge. A bead of hot melt adhesive is adhered to the inner surface of each cover piece in a pattern substantially parallel to and located inside of the peripheral edge. After the hot melt adhesive hardens, it forms a strip of elastomeric material. Then the cover pieces are placed together about the core of the ball and stitched together with the beads of hot melt adhesive material located within the stitching, so that the beads support the cover pieces to form a raised seam on the ball. The hot melt adhesive material is preferably selected to have a durometer hardness comparable to that of the core of the ball, so that the ball will perform substantially the same regardless of whether it is struck on-seam or off-seam by a batter.

28 Claims, 2 Drawing Sheets

BALL WITH RAISED SEAM

The present application is a continuation of and claims benefit of our co-pending U.S. provisional patent application Ser. No. 60/134,679, entitled "BALL WITH RAISED SEAM" filed May 18, 1999.

BACKGROUND OF THE INVENTION

Field of the Invention

The present invention relates generally to softballs and baseballs and more particularly, to such balls where the seam is raised higher than normal balls.

In an effort to improve balls, more specifically those balls used in Fast Pitch softball and baseball, manufacturers have tried different sewing techniques and different thread sizes in order to produce a ball with a raised seam.

One reason players prefer balls with raised seams is that it provides improved gripability of the ball and allows more curve to be placed on the ball when the ball is pitched.

One such prior art attempt is found in U.S. Pat. No. 5,772,544, to Yang, which describes a ball having a pad underneath the threads in order to protect the threads from being torn or worn during use.

Another such design is available from Wilson Sporting Goods Co., which is known as the Super Seam Technology (SST). The SST ball uses a sewing process and cover design that allows the seams of the balls to be 20% higher than traditional raised seam balls.

Still another such design is presently being marketed by Dynac Sports. The Dynac Sports' design includes a thread that is sewn under the cover during the stitching process of the balls.

There are, however, numerous shortcomings of all of these prior art attempts to manufacture a ball with a raised seam. Many of the designs do not produce consistent raised seams. Furthermore, the raised seams tend to be softer than the other portions of the ball and thus, cause performance problems when a batter impacts the ball on the seam. If the seam permanently deforms to a substantial degree upon impact with a bat, a substantial portion of the bat energy is absorbed by that deformation of the ball, thus reducing the distance the ball will travel.

Thus, there is a need for improved construction and methods of constructing softballs and baseballs having raised seams.

SUMMARY OF THE INVENTION

The present invention provides an improved construction for a softball or a baseball having a raised seam.

A ball includes a core and first and second cover pieces, each having an outer surface, an inner surface and a peripheral edge. A bead of hot melt adhesive is adhered to the inner surface of each cover piece in a pattern substantially parallel to and located inside of the peripheral edge thereof. The bead of adhesive is allowed to harden. Then, the cover pieces are stitched together with the stitching extending around the beads of hot melt adhesive so that the beads support the cover pieces to form a raised seam on the ball.

Preferably the material of the hot melt adhesive is chosen to have a durometer hardness comparable to that of the core of the ball so that a batter will feel no substantial tactile difference between hitting the ball on-seam or off-seam.

It is, therefore, an object of the present invention to provide an improved construction for balls, particularly softballs and baseballs.

Another object of the present invention is the provision of an improved ball having a raised seam.

Still another object of the present invention is the provision of a ball construction that will perform substantially the same when a bat impacts the ball on the seam, as it will perform when the bat impacts the ball off the seam.

Yet another object of the present invention is the provision of improved methods for manufacturing balls.

Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
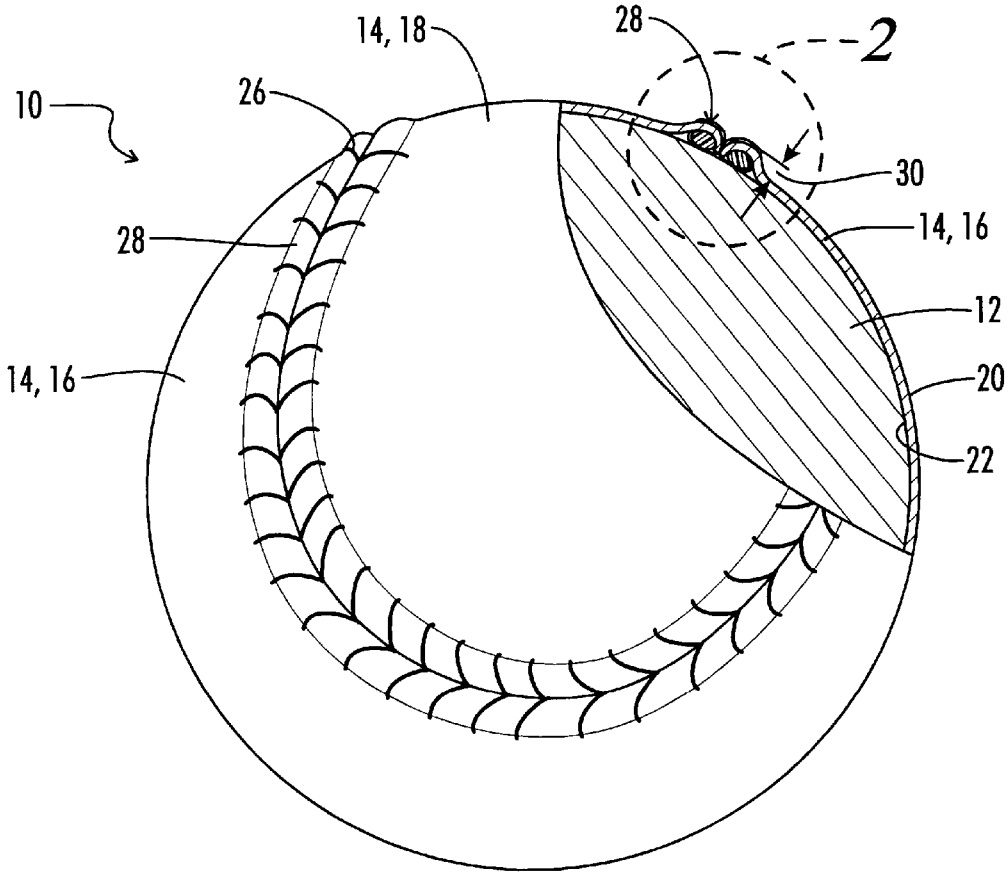
FIG. 1 is an elevation view of a softball constructed in accordance with the present invention. A portion of the ball is cut away to show a sectioned view of the seam construction of the ball.
Figure 2:
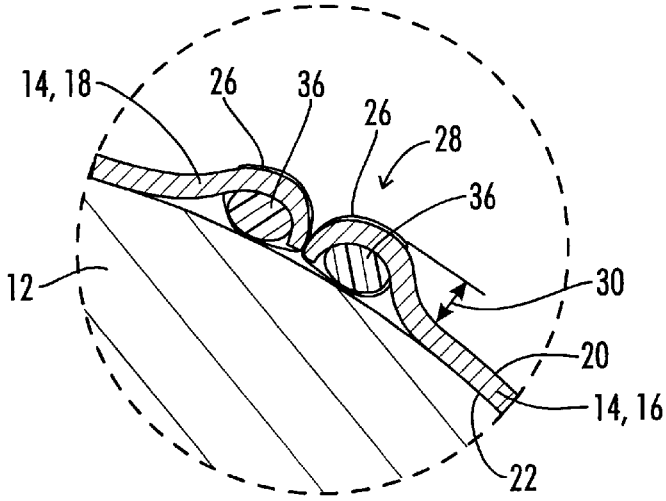
FIG. 2 is an enlarged view of the cut away portion of the ball of FIG. 1 contained within the dashed circle.

Referring now to the drawings, and particularly to FIG. 1, a ball constructed in accordance with the present invention is shown and generally designated by the numeral 10. The ball 10 includes a core 12. The core 12 may be of any conventional construction. One preferred construction for the core 12 is semi-rigid, polyurethane foam with durometer of approximately 30 D.

The core 12 is surrounded by a cover 14 which includes first and second figure 8-shaped cover pieces 16 and 18.

Figure 3:
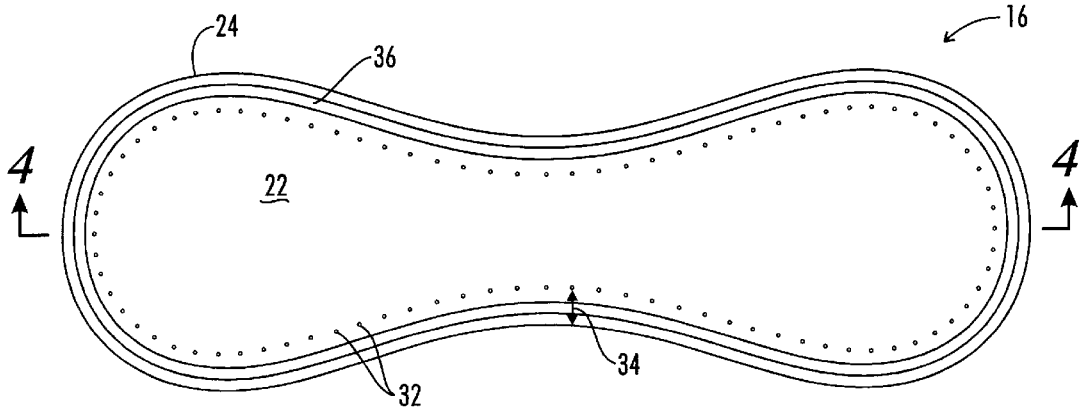
FIG. 3 is a laid out view of the underside surface of one of the cover pieces of the ball, having had the bead of hot melt adhesive applied thereto.
Figure 4:
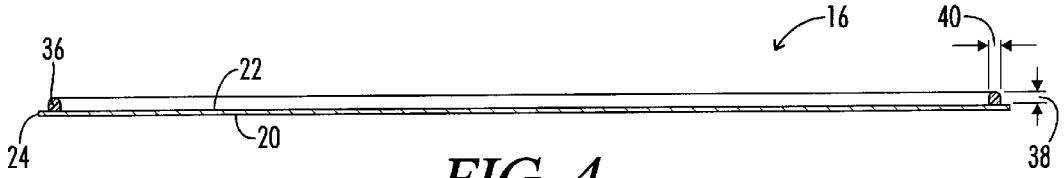
FIG. 4 is a section view taken along line 4—4 of FIG. 3.

A more detailed view of the first cover piece 16 is shown in FIGS. 3 and 4. The first cover piece 16 has an outer surface or outside surface 20, an inner surface or underside surface 22, and a peripheral edge 24. The peripheral edge 24 is best seen in FIG. 3 and is in a substantially figure 8-shape when the cover piece 16 is laid out on a flat surface prior to its attachment to the ball 10.

The cover pieces 16 and 18 are constructed from leather or a suitable leather substitute material and typically have a thickness on the order of 1/16 inch.

As is best seen in FIG. 1, the two figure 8-shaped cover pieces 16 and 18 are complementary to each other so that when they are placed about the core 12 with the peripheral edges in engagement with each other, the peripheral edges may be sewn together with stitching 26 to form a raised seam 28. The seam 28 extends a distance 30 above the outer surface 20 of the cover pieces.

As best seen in FIG. 3, each of the cover pieces such as 16 includes a series of preformed stitch holes 32 in a pattern substantially parallel to the peripheral edge 24 of each cover piece and spaced inward from that peripheral edge by a distance 34.

A bead 36 of hot melt adhesive is adhered to the underside 22 of each over piece between the stitch holes 32 and the peripheral edge 24 thereof. The bead 36 can be described as a bead of hot melt adhesive adhered to the inner surface 22 of cover piece 16 in a pattern substantially parallel to and located inside of the peripheral edge 24 thereof. The bead 36 may also be described as a length of elastomeric material 36.

In a manner which is further described below, the bead of hot melt adhesive 36 is laid down upon the inner surface 22 when the adhesive is in a hot fluid state. Then the adhesive is allowed to harden before assembly of the cover pieces with the core.

Then the cover pieces 16 and 18 are placed about the core 12 and stitched together as shown in FIG. 1. The stitching 26 connects the cover pieces 16 and 18 about the core 12 with the beads of elastomeric material 36 located within the stitching so that the beads 36 support the cover pieces 16 and 18 to form the raised seam 28.

METHODS OF MANUFACTURE

In one preferred embodiment of the present invention, the core 12 is constructed from polyurethane material having a durometer hardness of 30 D as measured on the D scale. A preferred hot melt adhesive for use with such a core is a particular polyolefin hot melt adhesive distributed by On-Hand Adhesives, Inc. of 1850 South Elmhurst Rd., Mt. Prospect, Ill. 60056, under the brand Hysol 236.

The Hysol 236 adhesive is a clear general purpose adhesive. It has a softening point of 180° F. It has a viscosity of 8,500 centipoise at 350° F. It has a working time of 25 seconds. It has a heat resistance HF/2PSI load of 140 PSI. It has a durometer hardness of 25 as measured on a D scale.

A hot melt adhesive of this type is supplied in bulk form as hot melt blocks/pellets. It may be applied with a conventional hot melt application system such as the ITW Dynatec DYNAMELT® S-05 adhesive supply unit available from On-Hand Adhesives, Inc. The bulk material is placed in a hopper where it is heated to a fluid state and then it is pumped to an adhesive valve which may be either automated or manually actuated to apply a bead of the liquid hot melt adhesive material to the leather cover pieces of the ball.

For a standard size softball having a nominal diameter of 3.820 inches, it is preferred that the raised seam 28 have a height 30 above the outer surface 20 of cover pieces 16 and 18 in the range of from ⅛ inch to 3/16 inch.

To achieve this height utilizing leather cover pieces having a thickness of approximately 1/16 inch, the bead 36 has a height 38 in the range of from 1/16 inch to ⅛60 inch, and a width 40 in the range of from 1/16 inch to ⅛ inch.

If the bead 36 is applied as a generally circular cross-section bead, it may be described as having a nominal diameter 40 in the range of from 1/16 inch to ⅛ inch.

In general, the various materials utilized as cores for a standard softball construction may have a durometer hardness in the range of from 5 to 35 measured on a D scale. For use with those cores, the hot melt adhesive material preferably has a durometer reading in the range of from 5 to 35 measured on a D scale.

In general, the hot melt adhesive material 36 and the core 12 should be selected to have durometer hardnesses sufficiently close to each other so that a batter feels no substantial tactile difference between hitting the ball 10 on the seam 28 or off the seam on the outer surface 20 of the cover pieces 16 and 18.

In general, hot melt adhesives may be described as a family or group of polymeric elastomeric materials which include many polyolefins and polyamides.

As previously noted, for any given ball construction, the particular hot melt adhesive material is preferably selected to complement the material of the core 12 so that the hot melt adhesive material and the core will have similar durometer hardnesses. This will allow the ball to perform in a consistent manner regardless of whether the batter strikes it on the seam or off the seam.

Other hot melt adhesive materials from which a suitable adhesive for any given application may be selected include those set forth in the following Table 1. The items in Table 1 are other specific adhesive formulations available from On-Hand Adhesives, Inc. under the Hysol trademark:

TABLE 1

| 1. Polyolefins (EVA) Hot Melts | Softening Point F | Viscosity Centipoise @350 F (t =250F) | Working Time | Heat Resistance F/2PSI Load | Typical Applications |
|---|---|---|---|---|---|
| QuickPac | 224F | 3,000 | 10 Sec. | 174 psi | Carton Closing |
| CoolMelt | 208F | 7,200t | 30 Sec. | 140 psi | Paper, Styrofoam, Polyethylene Plastics, Softwoods |
| Super Pac | 208F | 4,900 | 30 Sec. | 144 psi | Carton Closing, Foam |
| 1X | 216F | 2,000 | 15 Sec. | 150 psi | Wood, Paper, Foam |
| 3X | 209F | 4,300 | 60 Sec. | 135 psi | Sand Cores, Porous |
| 232 | 188F | 11,000 | 15 Sec. | 153 psi | Clear, General Purpose |
| 236 | 180F | 8,500 | 25 Sec. | 140 psi | Clear, General Purpose |
| 740 | 206F | 8,000 | 10 Sec. | 168 psi | Paper, Fabrics |
| 740LV | 206F | 3,500 | 10 Sec. | 155 psi | Paper, Fabrics |
| 0420 Spray | 208F | 10,500 | 2 Min. | 153 psi | Paper, Foam, Fabrication |
| 0430 Spray | 240F | 4,000 | 3.5 Min. | 170 psi | General Purpose, Plastic, Wood |
| 0450 Spray | 232F | 4,500 | 8 Min. | 156 psi | Urethane Foam |
| 1942 | 198F | 4,000 | 30 Sec. | 142 psi | Best General Purpose, Plastics |
| 1946 Pellets | 198 | 18,000 | 50 Sec. | 142 psi | ABS, Polystyrene, Rubber |
| 2000 | 189F | 500 | 15 Sec. | 140 psi | Ceramic, Porcelean |
| 4046 | 193F | 18,000 | 60 Sec. | 120 psi | Rubber, Plastics |
| 6009 | 315F | 3,000 | 25 Sec. | 300 psi | Polypropylene |
| **2. Polyamides Hot Melts** | **Softening Point F** | **Viscosity Centipoise @ 400F** | **Working Time** | **Heat Resistance F/2PSI Load** | **Typical Applications** |
| 7390 | 380F | 5,500 | 5 Sec. | 330 psi | Paper, Potting |
| 7460 Spray | 275F | 6,700 | 30 Sec. | 210 psi | Urethane Foam |
| 7480 | 250F | 3,900 | 50 Sec. | 211 psi | General Purpose |
| 7802 | 280F | 6,500 | 20 Sec. | 245 psi | General Purpose-High |
| 7804 | 280F | 2,600 | 35 Sec. | 220 psi | General Purpose-Low |
| 7804 FRM-HV | 280F | 3,500 | 30 Sec. | 220 psi | UL94V-O fire Retard |
| 7810 | 275F | 1,500 | 35 Sec. | 215 psi | Wood |
| 7811 | 310F | 4,000 | 35 | 266 psi | General Purpose-High Temp |
| 7815LV | 345F | 1,000 | 20 Sec. | 330 psi | Potting, Encapsulating |
| 7901 | 340F | 800 | 35 Sec. | 300 psi | Potting, Encapsulating |

After the appropriate hot melt adhesive material has been selected, the material is heated in an apparatus like that referred to above, and is then applied in a bead on the underside surface 20 of the cover pieces 16 and 18 as illustrated in FIGS. 3 and 4. The bead 36 will have the preferred dimensions described above, which are controlled by appropriate selection of the nozzles associated with the adhesive applying apparatus, and also are related to application pressure, application speed and the like.

Once the bead 36 has been laid down on the cover piece it will harden within a few seconds.

Then the cover pieces 14 and 16 may be placed about the core 12 and stitched together as shown in FIG. 1.

As will be understood by those skilled in the art, the stitching 26 is a conventional stitching pattern for baseballs and softballs. The thread passes up through one of the preformed holes 32 and then over the outer surface 20 and peripheral edge 24 of one cover piece and then under the peripheral edge and underside of the adjacent cover piece, then back up through one of the preformed holes 32 on the adjacent cover piece and then the process is repeated, thus creating the standard stitching pattern visible in FIG. 1.

By the present invention, a raised seam construction is provided which produces a performance enhancement when the bat impacts the ball on the seams. This is contrasted to most current raised seam designs and processes which result in raised seams which deform upon impact and thus dissipate energy resulting in a decrease in distance traveled by the ball.

By means of the present invention, the durometer hardness of the hot melt adhesive material forming the elastomeric strip which supports the raised seam, substantially matches that of the core 12 of the ball. Thus, the perception of a batter is that they cannot distinguish the difference between striking the ball 10 of the present invention on the seam 28 or off the seam 28. The batter feels no substantial tactile difference between an on-seam or off-seam hit, and the ball travels substantially the same distance regardless of whether it is hit on the seam or off the seam.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A ball comprising:

a core;

first and second cover pieces, each having an outer surface, an inner surface and a peripheral edge;

a bead of hot melt adhesive adhered to the inner surface of each cover piece in a pattern substantially parallel to and located inside of the peripheral edge; and stitching connecting the cover pieces together about the core with the beads located within the stitching, so that the beads support the cover pieces to form a raised seam on the ball.

2. The ball of claim 1, wherein:

the first and second cover pieces each include a series of preformed stitch holes in a pattern substantially parallel to the peripheral edge of each cover piece; and the bead of hot melt adhesive on each cover piece lies between the stitch holes and the peripheral edge of the cover piece.

3. The ball of claim 1, wherein the bead of hot melt adhesive on each cover piece has a height in the range of from 1/16 inch to 1/8 inch.

4. The ball of claim 3, wherein the bead of hot melt adhesive on each cover piece has a width in the range of from 1/16 inch to 1/8 inch.

5. The ball of claim 1, wherein the bead of hot melt adhesive on each cover piece has a nominal diameter in the range of from 1/16 inch to 1/8 inch.

6. The ball of claim 1, wherein the ball is a softball having nominal diameter of 3.820 inches, and the raised seam is raised to a height above the outer surface of the cover pieces in the range of from 1/16 inch to 3/16 inch.

7. The ball of claim 1, wherein:

the beads of hot melt adhesive have a durometer hardness reading in the range of from 5 D to 35 D.

8. The ball of claim 7, wherein:

the core has a durometer hardness reading in the range of from 5 D to 35 D.

9. The ball of claim 1, wherein the beads of hot melt adhesive and the core have durometer hardnesses sufficiently close to each other so that a batter feels no substantial tactile difference between hitting the ball on seam or off seam.

10. The ball of claim 1, wherein the hot melt adhesive comprise a polyolefin material.

11. The ball of claim 10, wherein the core comprises a polyurethane foam material.

12. The ball of claim 1, wherein the cover pieces comprise a leather material.

13. A ball, comprising:

a core;

a cover including cover pieces sewn together about the core to form a seam; and a length of elastomeric material located under the cover at the seam so that the seam is a raised seam, the elastomeric material having a durometer hardness sufficient to produce a performance enhancement when a batter impacts the ball on the seam; and wherein the elastomeric material and the core have durometer hardnesses sufficiently close so that a batter feels no substantial tactile difference between hitting the ball on seam or off seam.

14. The ball of claim 13, wherein the durometer hardness of the elastomeric material is at least 25 on a D scale.

15. A ball, comprising:

a core;

a cover including cover pieces sewn together about the core to form a seam; and a bead of hot melt adhesive adhered to an underside of the cover at the seam so that the seam is a raised seam, the hot melt adhesive having a durometer hardness sufficient to produce a performance enhancement when a batter impacts the ball on the seam.

16. The ball of claim 15, wherein the bead of hot melt adhesive on each cover piece has a height in the range of from 1/16 inch to 1/8 inch.

17. The ball of claim 16, wherein the bead of hot melt adhesive on each cover piece has a width in the range of from 1/16 inch to 1/8 inch.

18. The ball of claim 15, wherein the bead of hot melt adhesive on each cover piece has a nominal diameter in the range of from 1/16 inch to 1/8 inch.

19. The ball of claim 13, wherein the ball is a softball having nominal diameter of 3.820 inches, and the raised seam is raised to a height above the outer surface of the cover pieces in the range of from 1/16 inch to 3/16 inch.

20. The ball of claim 13, wherein:

the length of elastomeric material has a durometer hardness reading in the range of from 5 D to 35 D.

21. The ball of claim 20, wherein:

the core has a durometer hardness reading in the range of from 5 D to 35 D.

22. The ball of claim 13, wherein the length of elastomeric material comprises a polyolefin material.

23. The ball of claim 22, wherein the core comprises a polyurethane foam material.

24. A method of manufacturing a ball, comprising:

(a) providing a core;

(b) providing first and second cover pieces each having an outside surface, an underside surface and a peripheral edge;

(c) applying a bead of liquid adhesive to the underside surface of each cover piece adjacent the peripheral edge of the cover piece;

(d) allowing the adhesive to harden;

(e) after step (d), placing the cover pieces about the core; and (f) sewing the cover pieces together so that the bead of adhesive supports a raised seam of the ball.

25. The method of claim 24, wherein:

in step (d) the raised seam has a height of at least 1/16 inch.

26. The method of claim 24, wherein the bead of adhesive and the core have durometer hardnesses sufficiently close so that a batter feels no substantial tactile difference between hitting the ball on seam or off seam.

27. The method of claim 24, wherein the bead of adhesive has a durometer hardness sufficient to produce a performance enhancement when a batter impacts the ball on the seam.

28. The method of claim 24, wherein:

in step (c) the adhesive is a hot melt adhesive.

* * * * *